United States Patent [19]

Thompson et al.

[11] 4,256,510

[45] Mar. 17, 1981

[54] METHOD OF SCRAPING CORNERS

[76] Inventors: David E. Thompson, Stonegate, Fox Run Rd., Norwalk, Conn. 06850; Walter R. G. Haggstrom, 116 Canton Ave., Portsmouth, R.I. 02871

[21] Appl. No.: 932,919

[22] Filed: Aug. 11, 1978

[51] Int. Cl.[3] ..... B08B 7/00

[52] U.S. Cl. ..... 134/6; 15/93 R; 15/236 C; 51/328; 134/38

[58] Field of Search ..... 15/236 C, 104.19, 104.18, 15/212, 213, 93 R, 42, 198, 200, 49 R, 49 C, 98; 134/6, 38, 33; 51/328, 180, 16

[56] References Cited

U.S. PATENT DOCUMENTS

| | | | |
|---|---|---|---|
| 289,132 | 11/1883 | Petmecky | 15/104.18 |
| 552,450 | 12/1895 | Schulhoff | 15/104.18 |
| 1,685,380 | 9/1928 | Schultz | 15/104.19 |
| 1,721,106 | 7/1929 | Fischbeck | 15/104.19 |
| 2,599,077 | 6/1952 | Sturgis | 15/213 |
| 2,806,237 | 9/1957 | Love | 15/104.18 |
| 3,312,994 | 4/1967 | Fassio | 15/159 A |
| 3,958,294 | 5/1976 | Thompson et al. | 15/236 C |

*Primary Examiner*—S. Leon Bashore
*Assistant Examiner*—Michael L. Goldman
*Attorney, Agent, or Firm*—Robert L. Zink

[57] ABSTRACT

A drum-type rotary scraper, for use in a corner, scraping a surface by the snapping reformation of elastically restrained portions of flexible fingers deformed from their normal circular path by the constraint of the planes forming the corner.

By way of an example, a cylindrical bird-cage broom whose tips rotate bluntly and ineffectively against a first plane surface while the drum surface of the fingers immediately adjacent the tip ends, in deforming and scraping on the second and snapping onto the third of surfaces defined by the intersection of three planes at right angles, removes paint from two of these relatively inaccessible surfaces.

1 Claim, 11 Drawing Figures

METHOD OF SCRAPING CORNERS

BACKGROUND OF THE INVENTION

This invention is a rotary machine for treating work surfaces in corners, the effects being to remove the surface, clean, polish or anneal.

Rotary drum surface scrapers and the like are ineffectual in biplaner intersections, and even more ineffectual in triplaner intersections. Wire brushes deform, but when forced into corners with the axis of rotation approaching the corner fail to reach into the corner and aggrevate performance by over-abrading. These same brushes do not guarantee intimate contact of the scraping elements with the intersection when used with the rotational plane of the brush parallel to one side of the biplaner corner. Thus, treatment of corners, biplaner and triplaner, is usually left to non-powered hand tools.

Existing tools have not provided convenient cleaning of window mullions or floor corners, necessitating hand treatment. Especially, existing tools have not provided protection against damaging one surface of a biplaner corner while treating the second surface fully up to the intersection.

Many rasps and other drum type scrapers will load up with the material being removed, and must be periodically cleaned to restore the cutting effect. The invention, being of bird-cage design, allows the removed material to fall free of the scraping elements and be swept away by the action of the blades.

SUMMARY OF THE INVENTION

The object of the invention is to fully treat surfaces or remove surface layers in corners with a power tool with uncompromised effectiveness relative to performance on accessible surfaces. Examples of application are the removal of paint in floor edges and from window mullions, and cleaning of machined grooved surfaces without damage to the face of the groove.

It is a further object to selectively provide fingers in the form of blades that adapt to the deflection imposed by intersecting planes by utilizing the dynamics created by the interference of a rotating set of drum blades with such planes in order to maximize the effect on the surfaces of such planes proximate to the intersections of those surfaces. It is yet a further object to convert the constant driving torque on rotary drum oriented blades to vertical surface impact action upon the corner surface being worked.

The invention accomplishes these objects by providing flexible fingers retained at one or both ends in the rim of circular hubs mounted on a shaft suitable for being driven from such rotary power source as a portable power drill.

The embodiment using two hubs proves efficient in biplaner corners, whereas the embodiment using one hub and leaving the fingers free at one end proves efficient in triplaner corners, or in biplaner applications where non-disturbance of one surface is desired such as along window mullions. Both embodiments are of bird-cage design, and the dynamic effect of the double-hub barrel embodiment is comparable to the effect of the single hub embodiment since the latter may be equated to a bisection of the double-hub barrel model. The double-hub barrel embodiment must have blades that arc radially at their center in order to avoid hub contact with the surfaces, while the single-hub model when used with the finger ends against one plane, can be tilted to avoid hub contact, or may escape hub contact by the nature of the work as with window mullions.

Whereas in a normal scraper the scraping action arises from the inertia and spring force of the free blade as it strikes, grips, and tears the surface material, the present invention accomplishes this very action on a first plane and as the blade finds release from its functionally restrained state, performs double duty as it travels along the plane at increasing speed, finding kinetic freedom while following the planar path of the surface boundary restraint. Resulting striking at the intersection loosens and removes the surface material, creating a surface discontinuity thus providing a positive grip for the succeeding blades to clean the second plane.

The proper effect of the double-hub barrel tool is achieved by spring column loading the distal end of the tool to allow the blade to truncate its arc along its swept surface. This column loading can be easily adjusted by positioning nuts along threads on the drive shaft.

As the blade is initially work-loaded, the flexible construction of the blade allows an elastic rotation about its own longitudinal axis, and as the blade releases from the frictional constraint of scraping, it finds torsional release creating a slapping of the planer surface of the blade, additive to the leaf spring release, compounding the effect on the surface at the biplaner intersection. The single-hub embodiment provides an equivalent effect with the advantage that straight fingers may be cylindrically arranged since the axis of rotation is intended to be approximately perpendicular to one surface. The blunt tips trace a circle on a first hard surface which acts as a stop and guide to the rotating tool while the longitudinal end portions of the blades scrape and impact upon the second surface or the second and third surfaces of a multiplaner intersection.

By providing blades of polyhedronal cross section, the cutting edges can be maintained by manually rotating the blade about its own longitudinal axis to newly present sharp edges to the periphery. A blade of square cross section provides four presentable edges. Additionally, since the axis of the tool when treating two surfaces will in initial approach generally be held along the bisecting angle of the two surfaces, a flat face of the blade will be impacting the second surface at the intersection of the two surfaces. This allows the user to rely on impact treatment relative to scraping treatment, and minimize the surface damage if either paint removal or peening effects are desired.

Although the embodiments depict a square blade cross section, such a profile is not essential to the invention. Round wire will perform capably because much of the surface work is a result of impact. The characteristics of the performance may be fine-tuned, however, by varying the number of blades and the blade cross-sectional profile. These two parameters will govern the optimal operating distance of the rotational axis from the work surface corner, as well as the overall effect on the work surface created by the varying strike angle and contact travel angle of a given blade. The torsional deflection of a polyhedronal blade about its longitudinal axis will also be affected by the parameters, affecting the wiping action created by the restorative torque on the blade imposed from a fixed end. Centrifugal force aids the force of the blades against the work surface and extends the radius of the operating periphery. This effect is more pronounced in the single-hub embodiment because the blades are in the form of cantilever beams.

DETAILED DESCRIPTION

Figure 1:
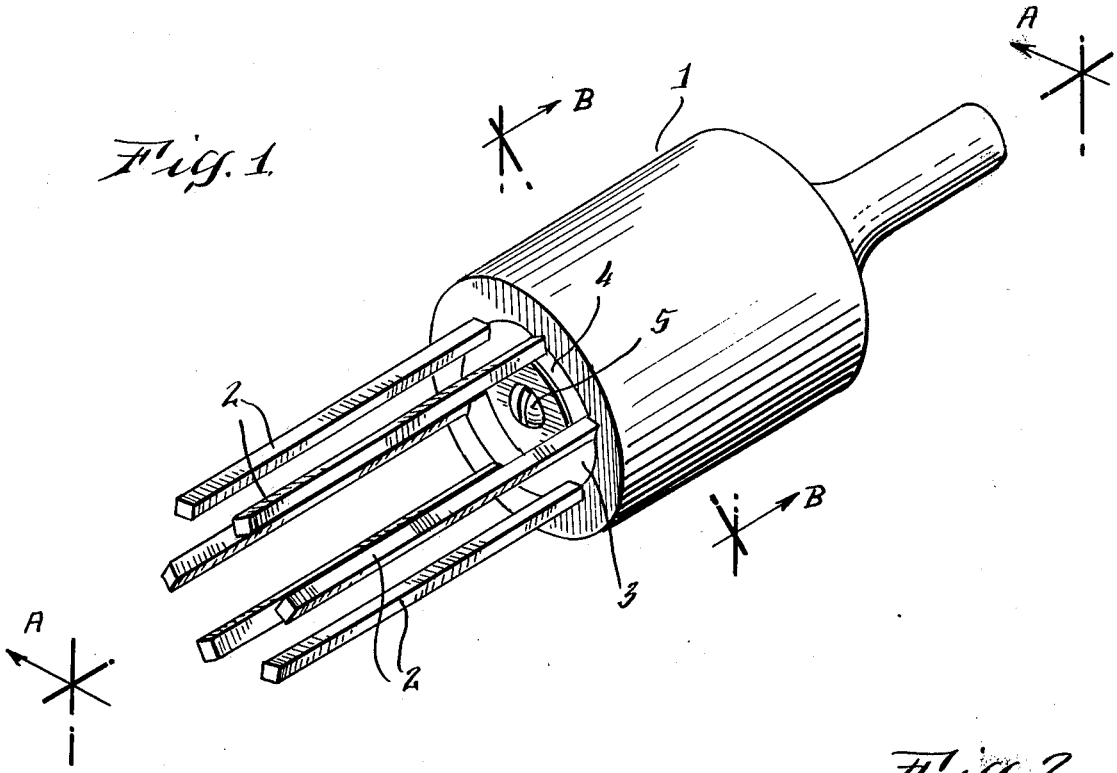
FIG. 1 is a perspective view of the single-hub embodiment of the invention.
Figure 2:
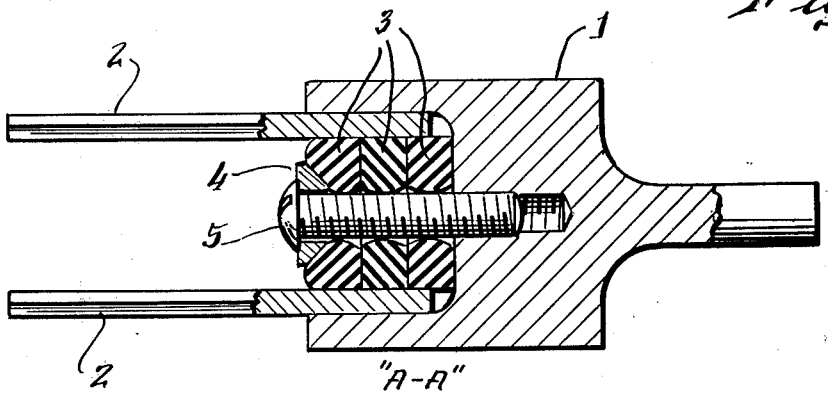
FIG. 2 is an axial cross section of FIG. 1.
Figure 3:
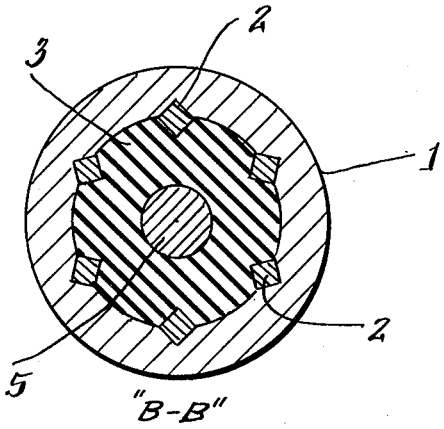
FIG. 3 is a trans-axial cross section of FIG. 1 taken through the hub.

A scraper hub (1) bears longitudinal flexible blades (2) which are held in place by the pressure of thick rubber gaskets (3) which squeeze the blades against recesses in the interior annular surface of the hub. The gaskets are under compression from the conical washer (4) and this compression, and accordingly, the force of the gaskets against the blades, is controlled by the distance through which a bolt (5) is threaded into the hub.

Figure 4:
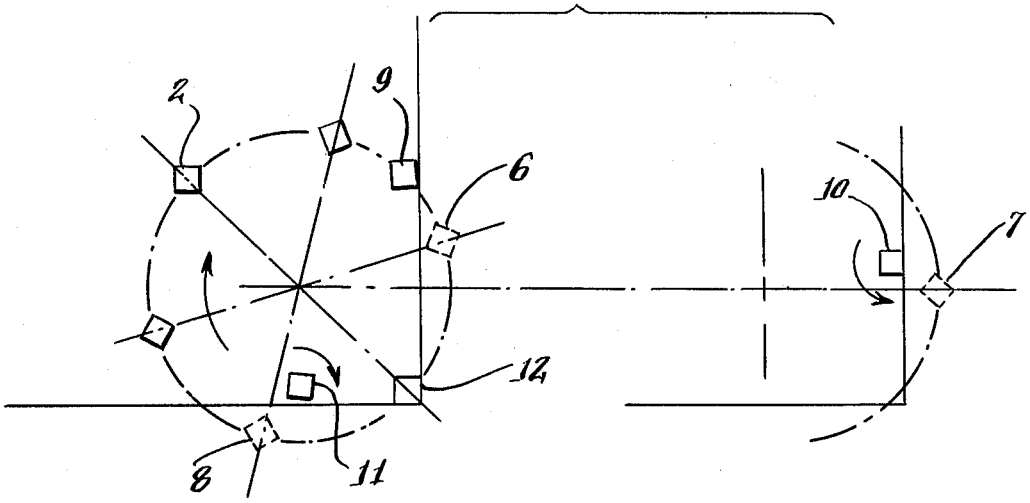
FIG. 4 is a trans-axial cross section taken through the blades, showing the blade positions in operation on a work surface.

FIG. 4 illustrates the interaction of six equally spaced blades (2) with a right biplaner surface by showing cross sections of the blades (2) at working positions. Theoretical free positions (6) and (7) and (8) are shown for three of six equally spaced blades, and their respective working positions (9) and (10) and (11) are depicted with arrows at (10) and (11) showing the direction of the restorative torsional forces arising from the torsional deflection caused by the work surface. At the initial strike position (9) the blade is under no torsional deflection. At the intersection position (12) the blade is conformed by the work surface to its theoretical free position.

Figure 5:
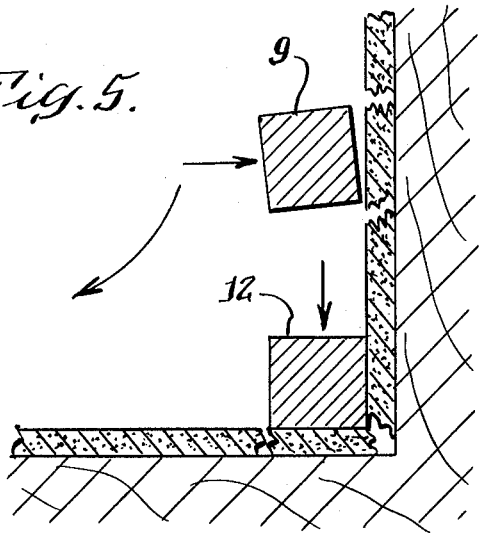
FIG. 5 is a detail of FIG. 4 showing the effect of initial blade impact.

FIG. 5 illustrates the loosening impact action of the blades at initial strike upon the work surface.

Figure 6:
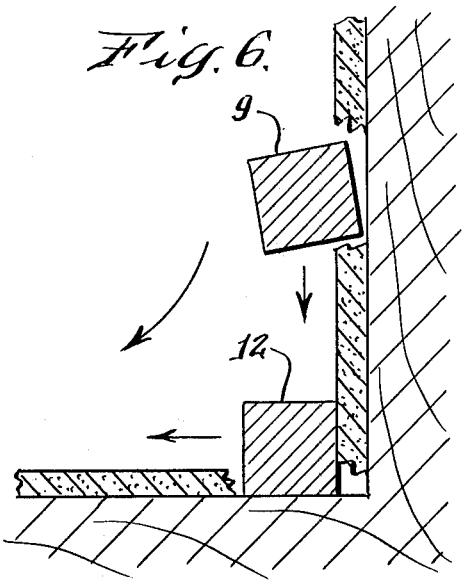
FIG. 6 is a similar detail showing the effect of subsequent blade strikes.

FIG. 6 illustrates the scraping action resulting from subsequent strikes.

Figure 7:
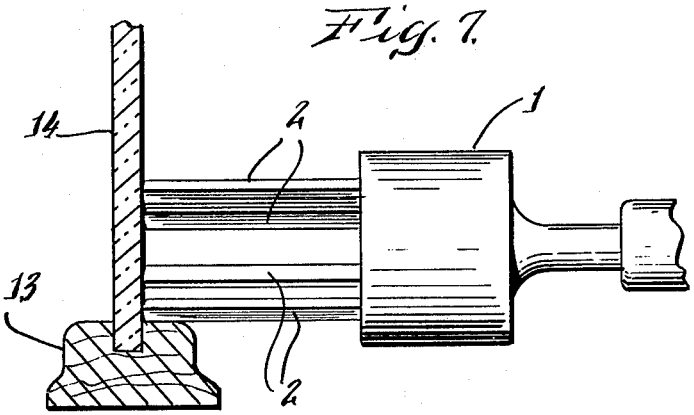
FIG. 7 illustrates the use of the single-hub embodiment on window mullions.
Figure 8:
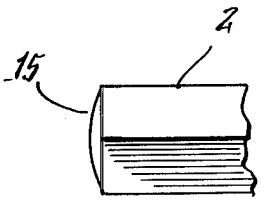
FIG. 8 is a detail of the blade tip of the single-hub embodiment.

FIG. 7 illustrates the use of the invention scraping a window mullion, (13), with the blunt tips of blades (2) rotating harmlessly on window pane surface (14). These blunt tips have a spherical surface (15) with radius approximately equal to the fulcrum distance of a power source, possibly hand-held, whose driving axis cannot be reliably held perpendicular to the glass pane. This radius avoids edge contact with the glass pane, yet is sufficiently large to present smooth bearing surface to the pane.

Figure 9:
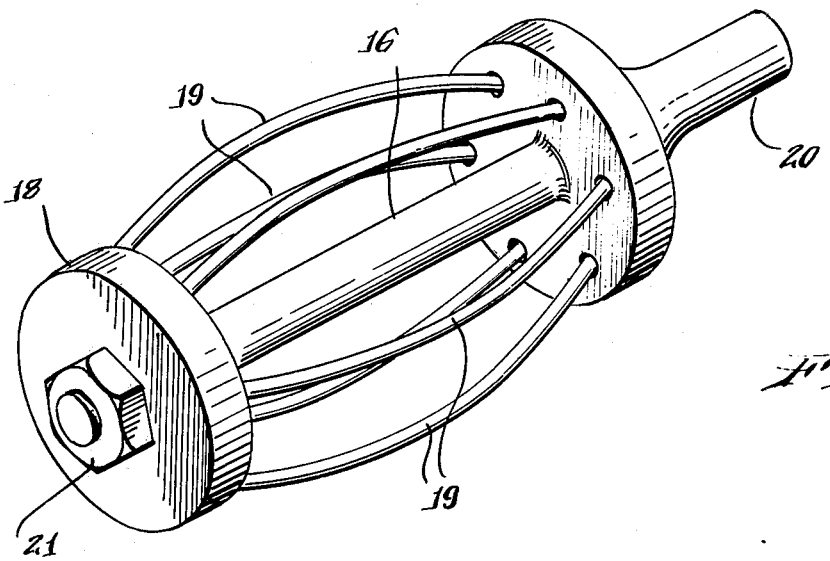
FIG. 9 is an isometric view of the double-hub barrel embodiment.
Figure 10:
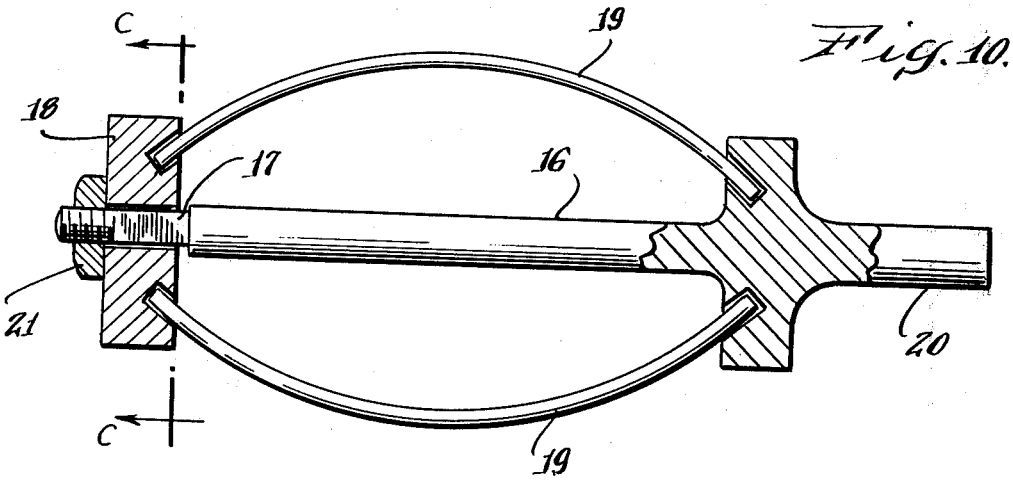
FIG. 10 is an axial cross section of the double-hub barrel embodiment.
Figure 11:
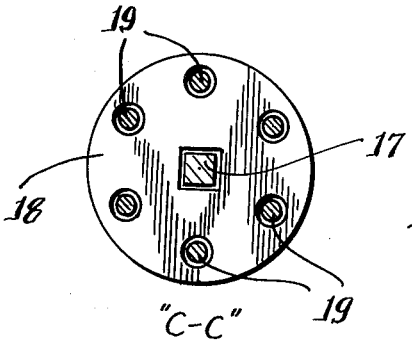
FIG. 11 is a cross section of FIG. 10 taken at the endplate face.

FIG. 9 shows the double-hub barrel embodiment for use in biplaner corners where it is desired to treat both planes. An elongated hub shaft (16) has a square portion (17) that retains an endplate (18) in rotational alignment with the hub shaft. The blades (19) are end-mounted into holes in the hub face (20) and the end plate (18). An adjusting nut (21) controls the distance of the end plate from the hub face, and thus controls the radius of arc of the blades (19). The blades (19) are retained in holes deep enough to prevent their being removed by working deflection. Should the full advantages of blades of polyhedronal cross section be required, the blades will have to be rotationally held at their ends by cementing, gibbing, or other fixing means.

I claim:

1. A method of scraping material from a region proximate to the intersection of at least two intersecting non-coplanar surfaces, the steps of said method including:

(A) providing a rotary scraper having:

(1) a longitudinally extending scraper hub having a front end surface and a rear end surface, (2) a plurality of longitudinally extending rotatable scraper blades mounted to the front end of said scraper hub and extending in a direction forwardly of said front end surface of said scraper hub, (3) means for rotating said scraper hub to cause rotation of said plurality of scraper blades, and (4) a second rotary scraper hub having the forwardly extending ends of each of said plurality of scraper blades mounted to said second rotary scraper hub, (B) positioning said rotary scraper relative to said at least two intersecting surfaces to be scraped such that the plane of rotation of said plurality of rotatable scraper blades is substantially perpendicular to the plane of each of said at least two intersecting surfaces, (C) rotating said plurality of rotatable scraper blades so that the longitudinal portions of each of said rotatable scraper blades strikes against each of said at least two surfaces to be scraped, whereby the impact of said longitudinal portions of each of said plurality of rotatable scraper blades against said at least two intersecting surfaces results in removal of material from said urfaces.

* * * * *